United States Patent [19]

Vogelbacher

[11] 4,017,948

[45] Apr. 19, 1977

[54] HEDDLE CARRYING RODS WITH CONNECTORS AND/OR PIECES

[75] Inventor: Erich Vogelbacher, Horgen, Switzerland

[73] Assignee: Grob & Co. Aktiengesellschaft, Horgen, Switzerland

[22] Filed: Mar. 23, 1976

[21] Appl. No.: 669,561

[30] Foreign Application Priority Data

Apr. 3, 1975 Switzerland ..... 4259/75

[52] U.S. Cl. ..... 28/46; 139/92; 403/292

[51] Int. Cl.[2] ..... D03J 1/14; D03C 9/00

[58] Field of Search ..... 139/91, 92; 28/42, 46; 403/292, 339, 340

[56] References Cited

UNITED STATES PATENTS

| | | | |
|---|---|---|---|
| 1,516,601 | 11/1924 | Hawkesworth | 403/339 |
| 2,722,949 | 11/1955 | Kaufmann | 139/92 |
| 3,121,936 | 2/1964 | Meierhofer | 28/46 |
| 3,430,313 | 3/1969 | Koch | 28/46 |
| 3,502,359 | 3/1970 | Lucci | 403/292 |
| 3,922,101 | 11/1975 | Salmon et al. | 403/292 |

*Primary Examiner*—Henry S. Jaudon
*Attorney, Agent, or Firm*—Sughrue, Rothwell, Mion, Zinn & Macpeak

[57] ABSTRACT

The heddle carrying rods are provided with open ended axially extending slots in each end. Connectors are provided having longitudinal edges complementary to the longitudinal edges of the slots to define a tongue and groove connection. One end of a connector may be slidably connected in the slot with the opposite end having a locking configuration to retain the connector in the slot for preventing the removal of heddles from the rod, a bevelled end piece configuration to facilitate the insertion of heddles on the rod or an identical symmetrical configuration for insertion into a slot in another rod to facilitate transfer of heddles from one rod to another.

9 Claims, 20 Drawing Figures

HEDDLE CARRYING RODS WITH CONNECTORS AND/OR PIECES

BACKGROUND OF THE INVENTION

1. Field of the Invention

The present invention is directed to heddle rods and more specifically to connecting means for securing end pieces, or other rods to the ends of the heddle rods.

2. Prior Art

Heddle carrying rods adapted to be mounted on the heddle frames have been provided in different sizes for many decades. Heddle carrying rods having dimensions of 9 × 1.5 mm were adopted worldwide for carrying heddles having closed end loops which were principally used on slider heddle frames. Other heddle carrying rods having dimensions of 10 × 1.5 mm are also provided but these constitute only a small percentage of the world market. There are also several types of heddle carrying rods having special dimensions but these are insignificant in number. Fundamentally, the heddle carrying rods have to be adapted to the end loops of the heddles which are largely standardized. Since the existence of heddles and heddle carrying rods, the heddles have had to be lined up on and removed from the heddle carrying rods with some frequency. The heddles are slid from transporting rods onto heddle carrying rods and from there onto storing or cleaning rods, etc. This work is part of the daily routine and depending on the size of the weaving installation the number of persons engaged in this operation may vary. Depending on the dimensions and tolerances of the end loops of the heddles and of the heddle carrying rods the heddles can be slid from one rod to another with varying degrees of difficulty. Bent or soiled end loops cannot be avoided in the weaving process and make the work of transferring the heddles much more difficult. If the transferring of heddles does not succeed smoothly, the end loops will be out of alignment on the rods and may cause the heddles to entangle. The realignment of the heddles is time consuming and very uneconomical. Therefore, eliminating the entangled heddles is as a rule the cheapest remedy.

In comparison to the above-mentioned heddles with closed end loops, heddles provided with open end loops are commonly lined up on the heddle carrying rods which measure 22 × 1.7 mm and 16 × 2.1 mm. Since these heddle carrying rods are slightly larger in dimension, and since the end loops of these heddles are open on one side, coupling devices have been successfully in use for many years which facilitate the transfer of the heddles from one rod to the other smoothly and effortlessly. However, for a long time the need has existed to develop a connector for the heddle carrying rods suited for heddles having closed end loops. In the course of the last decade the demand for such a device has constantly increased because the desire to economize weaving operations is affected by the transferring process for heddles which has become laborious and time consuming. Since the dimensions of the heddle carrying rods are relatively small and since the connectors should be sturdy and may only slightly protrude beyond the cross-sectional outline of the heddle carrying rods, no designs were known until now which fulfilled the desired requirements.

The task is rendered more difficult since the ends of the heddle carrying rods cannot be randomly formed. These ends have to be held in the heddle frames since the ends of the heddle carrying rods are usually fitted into a slot in the lateral support the exact fit of the rod in these slots must be guaranteed. Furthermore, the ends of the heddle carrying rods may not have any rough or burred edges, otherwise the lateral supports which are usually made from compressed wood would be damaged. Furthermore, the ends must be resistant to any damage which might occur while removing the heddle carrying rods from the heddle frames and while transporting them in the drawing-in department and weaving room. Additionally, the heddles should not be able to slide off the bars during transportation. Finally, the cost should be taken into consideration since the price for the heddle carrying rods which are used in bulk should not be substantially increased. Also, the coupling parts should be as inexpensive as possible.

SUMMARY OF THE INVENTION

The object of the present invention is to eliminate the disadvantages of known heddle carrying rods having connectors and/or end pieces and to fulfill the aforementioned requirements. This is achieved according to the present invention by providing at least one end of the heddle carrying rod with a longitudinal slot extending inwardly from the end of the rod to divide the end of the rod into two fork-shaped shanks and by providing a connector and/or end piece which is shaped as a complementary slider which can be guided into the slot and held therein by engagement with the shanks.

The foregoing and other objects, features and advantages of the invention will be apparent from the following more particular description of preferred embodiments of the invention as illustrated in the accompanying drawings.

DETAILED DESCRIPTION OF THE PREFERRED EMBODIMENTS

Figure 1:
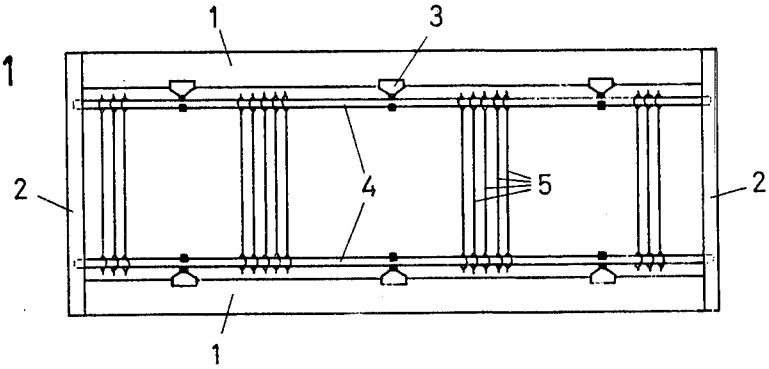
FIG. 1 is a front elevation view of a heddle frame.
Figure 2:
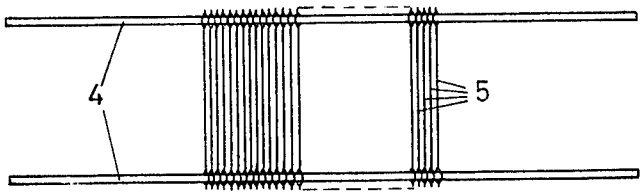
FIG. 2 is a front elevation view of a plurality of heddles lined up on the heddle carrying rods outside of the frame.

The heddle frame shown in FIG. 1 is comprised of a pair of parallel frame staves 1 connected to a pair of lateral supports 2. The pair of heddle carrying rods 4 having a plurality of individual heddles lined up thereon are shown as they are mounted in the frame in FIG. 1 and separately in FIG. 2.

Figure 3:
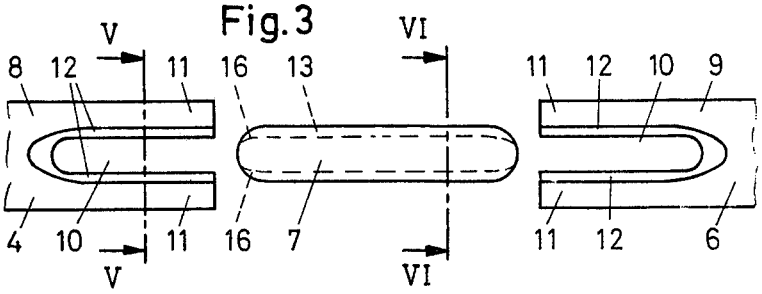
FIG. 3 is an exploded view of two rod ends and the connector for joining the rods together.
Figure 7:
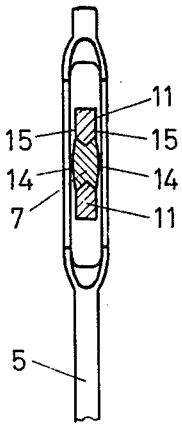
FIG. 7 is a cross-sectional view taken along the line VII—VII in FIG. 4.
Figure 4:
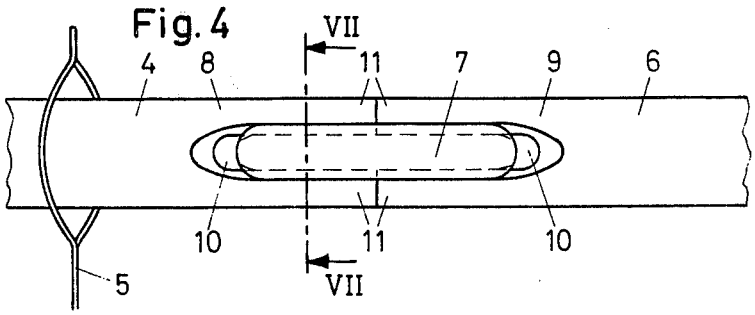
FIG. 4 is a view showing the elements of FIG. 3 connected together.
Figure 5:
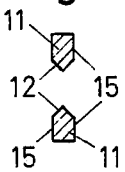
FIG. 5 is a cross-sectional view taken along the line V—V in FIG. 3.
Figure 6:
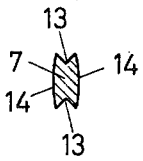
FIG. 6 is a cross-sectional view taken along the line VI—VI in FIG. 3.

In FIG. 3 the end 8 of a heddle carrying rod 4 in the end 9 of a cleaning rod 6 are shown in aligned unconnected relation with a connector 7 according to the present invention. The connector 7 is shaped as a slider and a connection for securing the rod ends 8 and 9 in aligned abutting relation as best seen in FIG. 4. One end of the connector 7 is slid into the slot 10 between the two shanks 11 of the rod end 8 and the other end of the connector 7 is slid into the slot 10 between the shanks 11 of the rod end 9. In the embodiment shown in FIGS. 3–7 the opposed surfaces of the shanks 11 are bevelled on opposite sides at 12 to mate with the complementary V-shaped grooves 13 formed in opposite sides of the connector 7. The connector 7 may be formed of flexible plastic material which will accommodate any inaccuracies in the formation of the slots 10. In order to provide the connector with a certain stability the lateral surfaces 14 may be slightly bowed outwardly so that when the connector is inserted into a rod end the lateral surfaces will protrude slightly beyond the lateral planes of the rod as best seen in FIG. 7. In order to facilitate the insertion of the connectors 7 into the rod ends 8 and 9 the grooves 13 may be slightly shaped or bevelled inwardly toward the central longitudinal axis of the connector at each end as at 16 in FIG. 3.

Figure 8:
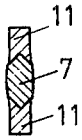
FIG. 8–12 are sectional views similar to FIG. 7 without the heddle showing five different embodiments for the complementary configuration of heddle rod and connector.
Figure 9:
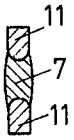
Figure 10:
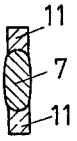
Figure 11:
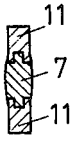
Figure 12:
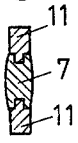

While it is necessary for the opposed edges of the connector 7 and the shanks 11 to be complementary they do not necessarily have to have the exact configuration shown in FIGS. 3–7. In the embodiment of FIG. 8 the guiding surfaces are reversed from that shown in FIG. 7, that is, the grooves are formed in the opposed surfaces of the shanks 11 and the side edges of the connector 7 are bevelled. In FIGS. 9 and 10 the complementary sliding surfaces of the shanks 11 and connector 7 are shaped in a concave or convex form, respectively. In FIGS. 11 and 12 a tongue and groove connection is provided between the connector 7 and the shanks 11 with the tongues being formed on the connector 7 in FIG. 11 and on the shanks 11 in FIG. 12. In both of these embodiments the contacting surfaces are at right angles and parallel to each other.

Figure 13:
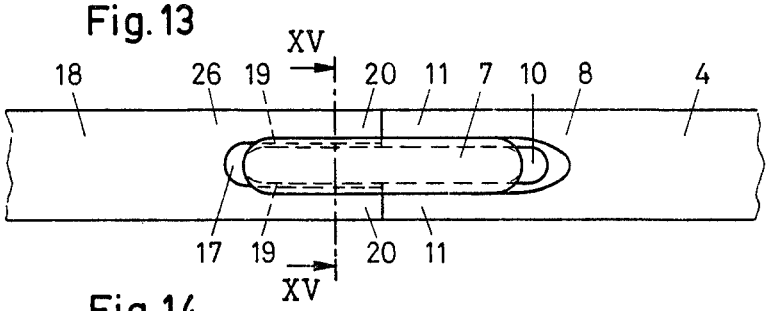
FIG. 13 is an elevational view of a heddle carrying rod connected to a thinner auxiliary rod.
Figure 15:
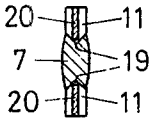
FIG. 15 is a cross-sectional view taken along the line XV—XV in FIG. 13.
Figure 14:
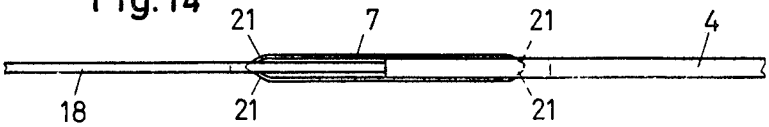
FIG. 14 is a side view of the arrangement shown in FIG. 13.

The embodiment illustrated in FIGS. 13–15 provides a connection between two rods having different thicknesses. The heddle carrying rod 4 is provided with the standard dimensions of 9 × 1.5 mm whereas the rod 18 is a considerably thinner auxiliary or transporting rod having a thickness of only 0.5 mm. The slot 17 in the auxiliary rod 18 is formed with unbevelled edges 19 since the rod is so thin in the first place. Since the inner surfaces 19 of the shanks 20 are not bevelled and therefore do not reach down to the base of the grooves 13 in the connector 7, the slot 17 is made slightly wider than the slot 10 in the rod end 8 of the heddle carrying rod 4. This is best seen in FIG. 15. In order to facilitate a perfect transferring of the heddles 5 from the thinner auxiliary rod 18 onto the thicker heddle carrying rod 4 the ends of the connector 7 are provided with a slight bevelled surface 21. In order to use the connector 7 on both sides in a thinner auxiliary rod 18 both ends of the connector 7 are provided with these bevelled surfaces 21.

Figure 16:
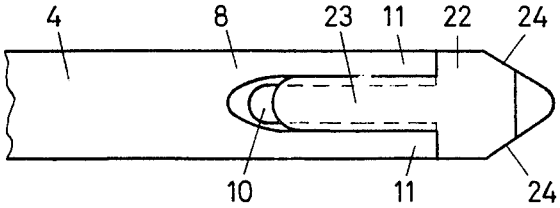
FIG. 16 is an elevational view of a heddle carrying rod having a head piece secured in the end slot thereof.
Figure 17:
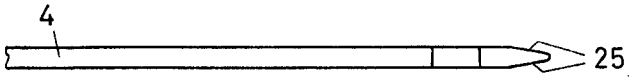
FIG. 17 is a side view of the arrangement shown in FIG. 16.

A further embodiment of the invention is shown in FIGS. 16 and 17 wherein an end piece or head piece 22 is provided for insertion into the slot 10 in the rod end 8 of the heddle carrying rod 4. The head piece 22 is provided with a tongue-shaped part 23 the cross-section of which corresponds exactly to the cross-section of a connector which is useable within the same slot 10. The cross-section of the head piece 22 corresponds to the cross-section of the heddle carrying rod 4. The opposite end of the head piece 22 is provided with tapered edges 24 and 25 as best seen in FIGS. 16 and 17 and is used to assist guiding individual heddles onto the heddle carrying rod by hand. Furthermore, it is also possible to shape the head piece 22 for any particular purpose such as for use in an automatic drawing-in machine.

Figure 18:
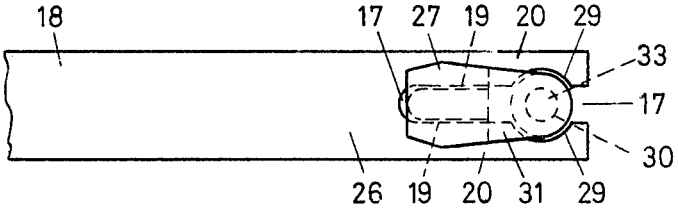
FIG. 18 is an elevational view of a locking piece in combination with a thin auxiliary rod.
Figure 19:
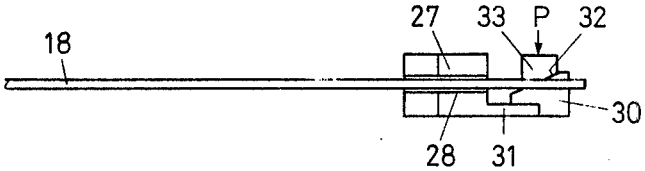
FIG. 19 is a side view of the arrangement shown in FIG. 18.
Figure 20:
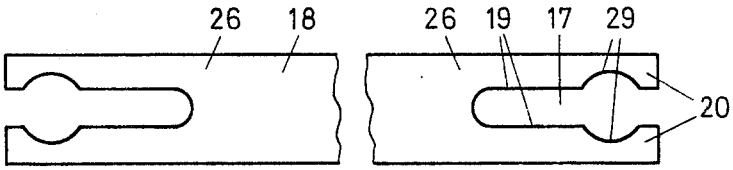
FIG. 20 is an elevational view with the center portion broken away of an auxiliary rod without the locking piece.

The relatively thin auxiliary rods 18 illustrated in FIGS. 13 and 14 are primarily used as dispatching, transporting or storing rods. For this purpose the rod ends 26 have to be provided with a lock to prevent the heddles 5 from sliding off the rod. To achieve this in prior art structures a hole was punched into the end of the conventional rod into which a metal split pin was inserted. Since this type of lock device is no longer suitable due to the presence of the slot 17 according to the present invention, the securement of a locking device has to be accomplished in a different manner. FIGS. 18 and 19 show a special locking piece 27 for this purpose. The locking piece 27 is provided on both longitudinal sides with guiding grooves 28, the distance between which is slightly smaller than the width of the slot 17. Furthermore, the width of the guiding grooves 28 is slightly wider than the thickness of the auxiliary rod 18. Therefore, the locking piece 27 can easily be slid between the shanks 20 from the rod end 26. Close to the rod end 26 both shanks 20 are provided on their inner surface 19 with a circular cut out. These cut outs 29 are provided to receive a plug 30 which is formed on a reduced thickness flap 31 of the locking piece 27. This plug 30 is disposed at right angles to the longitudinal direction of the locking piece 27 and the auxiliary rod 18. The height of the plug 30 is such that the plug 30 will extend on opposite sides of the auxiliary rod 18. The plug 30 is provided with a bevelled surface 32 which faces toward the flap 31 so that upon insertion of the locking piece 27 into the slot 17 the rod end 26 of the auxiliary rod 18 will engage the inclined surface to cam the plug 30 out of the plane of the auxiliary rod. Since the complete locking piece 27 is made of plastic material the flap 31 will provide the necessary elasticity for bending the plug 30 out of the plane of the rod 18. As soon as the locking piece 27 is slid completely into the slot 17 the plug 30 will be aligned with the circular cut out 29 and due to the resiliency of the flap 31 will move into the circular cut out to secure the locking piece on the end of the rod 18. In order to remove the locking piece 27 an extension 33 is provided on top of the plug 30 so that by applying pressure in the direction of the arrow P the flap 31 will be bent away from the rod 18 so that the plug 30 will be disengaged from the circular cut out 29 to allow the withdrawl of the piece 29 from the rod end 26. FIG. 20 shows both ends 26 of an auxiliary rod 18 without the locking piece 27.

With the present design it is now possible for the first time to couple closed end loop heddle carrying rods onto magazine rods, cleaning rods, packing rods and the like to provide for the easy transfer of the closed end loop heddles from one rod to the other. The slots can be provided in the ends of the heddle carrying rods simultaneously with the cutting of the rods to the desired length. The only additional operation would be the bevelling of the slot edges. The coupling parts can be molded from plastic material and therefore are very inexpensive to produce.

While the invention has been particularly shown and described with reference to preferred embodiments thereof it will be understood by those in the art that the foregoing and other changes in form and details may be made therein without departing from the spirit and scope of the invention.

What is claimed is:

1. In a heddle rod of the type having a flat elongated substantially rectilinear configuration adapted to carry heddles having closed end loops, the improvement comprising said rod having a longitudinally extending open ended slot in at least one end thereof defining a pair of shanks and attachment means being of a thickness substantially equal to the thickness of the rod so that the closed end loops of heddles can pass over said attachment means; said attachment means being detachably secured to said end of said rod including a flat elongated projection having upper most and lower most surfaces slidably disposed within said slot in engagement with said shanks, the opposing surfaces of said shanks and said projection having substantially complementary interfitting configurations to prevent lateral separation of said projection and said rod.

2. In a rod as set forth in claim 1 wherein said attachment means is comprised of an elongated slider having said projection on one end and an identical projection at the opposite end thereof for detachable connection with a second rod having an end slot similar to the end slot in the first mentioned rod for coupling two rods together.

3. In a heddle rod as set forth in claim 2 wherein said opposing surfaces on said projections and said shanks are formed with tongue and groove connections.

4. In a heddle rod as set forth in claim 1 wherein said attachment means is comprised of an end piece having a central portion with a cross-section similar to the cross-section of said rod, said flat elongated projection at one end thereof detachably secured in said slot and a tapered portion at the other end adapted to facilitate the placement of closed end loop heddles on said rod.

5. In a heddle rod as set forth in claim 4 wherein the engaging surfaces of said shanks and said flat elongated projection on one end of said attachment means have complementary tongue and groove configurations.

6. In a heddle rod as set forth in claim 1 wherein said attachment means is constructed of plastic material.

7. In a heddle rod as set forth in claim 1 wherein said heddle carrying rod is provided with identical slots at opposite ends thereof.

8. In a heddle rod of the type having a flat elongated substantially rectilinear configuration adapted to carry heddles having closed end loops, the improvement comprising said rod having a longitudinally extending open ended slot in at least one end thereof defining a pair of shanks and attachment means detachably secured to said end of said rod including a flat elongated projection having upper and lower surfaces slidably disposed within said slot in engagement with said shanks; said attachment means is comprised of a locking piece for retaining heddles on said rod, said locking piece having enlarged portions on opposite sides of said projection which will prevent passage of heddles when said locking piece is disposed in said slot and retaining means for securing said locking piece in said slot.

9. In a heddle rod as set forth in claim 8 wherein said retaining means is comprised of opposed cut out portions in said shanks adjacent the free ends thereof and plug means wider than said slot disposed within said cut out portions, flexible flap means securing said plug means to said locking piece whereby said plug means may be moved out of the plane of said slot to facilitate the entry and removal of said locking piece from said slot.

* * * * *